United States Patent [19]

Gilpin

[11] Patent Number: 5,002,310

[45] Date of Patent: Mar. 26, 1991

[54] DOCUMENT SHEET WITH DETACHABLE PORTION HAVING ADHESIVE STRIP FOR ATTACHMENT OF ADDENDUM

[76] Inventor: Leo J. Gilpin, 2859 S. 95th St., West Allis, Wis. 53227

[21] Appl. No.: 265,053

[22] Filed: Oct. 31, 1988

[51] Int. Cl.[5] ..... B42D 5/00

[52] U.S. Cl. ..... 281/2; 281/5; 281/38; 283/61; 283/117

[58] Field of Search ..... 281/2, 4, 15, 16, 5, 281/38; 283/98, 99, 100, 101, 106, 62, 105, 117, 81, 57, 58, 59, 61; 428/40, 43, 194, 343; 229/71, 73

[56] References Cited

U.S. PATENT DOCUMENTS

| | | | |
|---|---|---|---|
| 1,003,326 | 9/1911 | Broudy | 281/38 |
| 1,196,449 | 8/1916 | Enholm | 281/38 |
| 1,241,049 | 9/1917 | Stevens | 281/38 |
| 2,030,135 | 11/1936 | Carpenter | 428/194 |
| 2,321,184 | 6/1943 | Butterworth | 283/81 |
| 2,747,894 | 5/1956 | Porter | 281/2 |
| 4,032,679 | 6/1977 | Aoyagi | 283/101 |
| 4,157,842 | 6/1979 | Silver | 281/38 |
| 4,339,486 | 7/1982 | Shimamoto et al. | 428/40 |
| 4,428,997 | 1/1984 | Shulman | 283/101 |
| 4,568,108 | 2/1986 | Simpson | 281/2 |
| 4,590,109 | 5/1986 | Holmberg | 428/40 |
| 4,636,099 | 1/1987 | Goldstone | 281/2 |
| 4,768,810 | 9/1988 | Mertens | 428/43 |
| 4,927,071 | 5/1990 | Wood | 229/71 |

FOREIGN PATENT DOCUMENTS

| | | | |
|---|---|---|---|
| 30144 | of 1910 | United Kingdom | 283/106 |

*Primary Examiner*—Douglas D. Watts
*Assistant Examiner*—Hwei-Siu Payer
*Attorney, Agent, or Firm*—Quarles & Brady

[57] ABSTRACT

A preprinted document having an operative portion provided with a means for temporarily attaching related addendum. The attachment means comprises a non-drying, slightly tacky, pressure sensitive adhesive.

3 Claims, 2 Drawing Sheets

DOCUMENT SHEET WITH DETACHABLE PORTION HAVING ADHESIVE STRIP FOR ATTACHMENT OF ADDENDUM

BACKGROUND AND FIELD OF THE INVENTION

This invention relates to a system for temporarily attaching addendums to related documents. A particular application of the present invention relates to the use of a non-drying slightly tacky pressure-sensitive adhesive strip adjacent operative indicia on a document to temporarily attach related addendums such as checks.

Documents used in business, government and consumer transactions are generally either informative or require, permit, or suggest certain appropriate action. Documents which require action by the recipient or holder thereof frequently require submission or handling with related documents or addendum. For example, commonly in business consumer transactions a bill will be divided into two sections. A first top section summarizing the billing information such as breakdown of charges, accounting of rates, mailing addresses and the like. The bottom portion of the document, which is often removable, will commonly be an invoice which is required to be sent with the payment.

The payment and the invoice are closely related and frequently undergo common handling steps by the sending and/or receiving party. In order to insure that the invoice does not become separated from the payment (e.g., a check) during the common handling steps, frequently the payment is attached to the invoice.

Attaching means commonly employed by the payee or the payee's agent are staples or paper clips. Both these attachment means however are not necessarily desirable and have numerous disadvantages. For example, additional handling is required to remove the paper clip or staple which often results in damage to either the attached addendum and/or the document itself. Such damage can complicate further handling. Clips and staples also result in undesirable waste products and related disposal problems. Paper clips are further undesirable in that they easily slide off, resulting in premature detachment of the addendum.

The use of physically separate temporary attachment means, such as paper clips or staples, is further disadvantaged in that conscious effort is required by the sender to locate and use the separate attachment means. As such, the attachment means are not always employed. This results in an increased likelihood of separation of the addendum from the associated documents in the handling process.

It is accordingly a general object of the present invention to substantially alleviate the above noted problems in the art.

It is a more specific object of the present invention to provide a convenient system for temporarily adhering addendum to related documents in a readily removable manner.

It is a further object of the present invention to provide a document with an integral attachment means for attaching a related addendum which means allows subsequently detachment of the addendum.

SUMMARY OF THE INVENTION

The present invention is directed to a preprinted document having at least two sides wherein at least a portion of the preprinted indicia is operative text or nontext requiring action by the recipient or holder. Adjacent and integral with the operative text portion of the document there is provided a means for temporarily attaching related addendum comprising a strip of non-drying, slightly tacky pressure-sensitive adhesive. The adhesive strip being of such a size that following attachment of the addendum there will be little or no exposed adhesive.

DETAILED DESCRIPTION OF THE PREFERRED EMBODIMENTS

Figure 1:
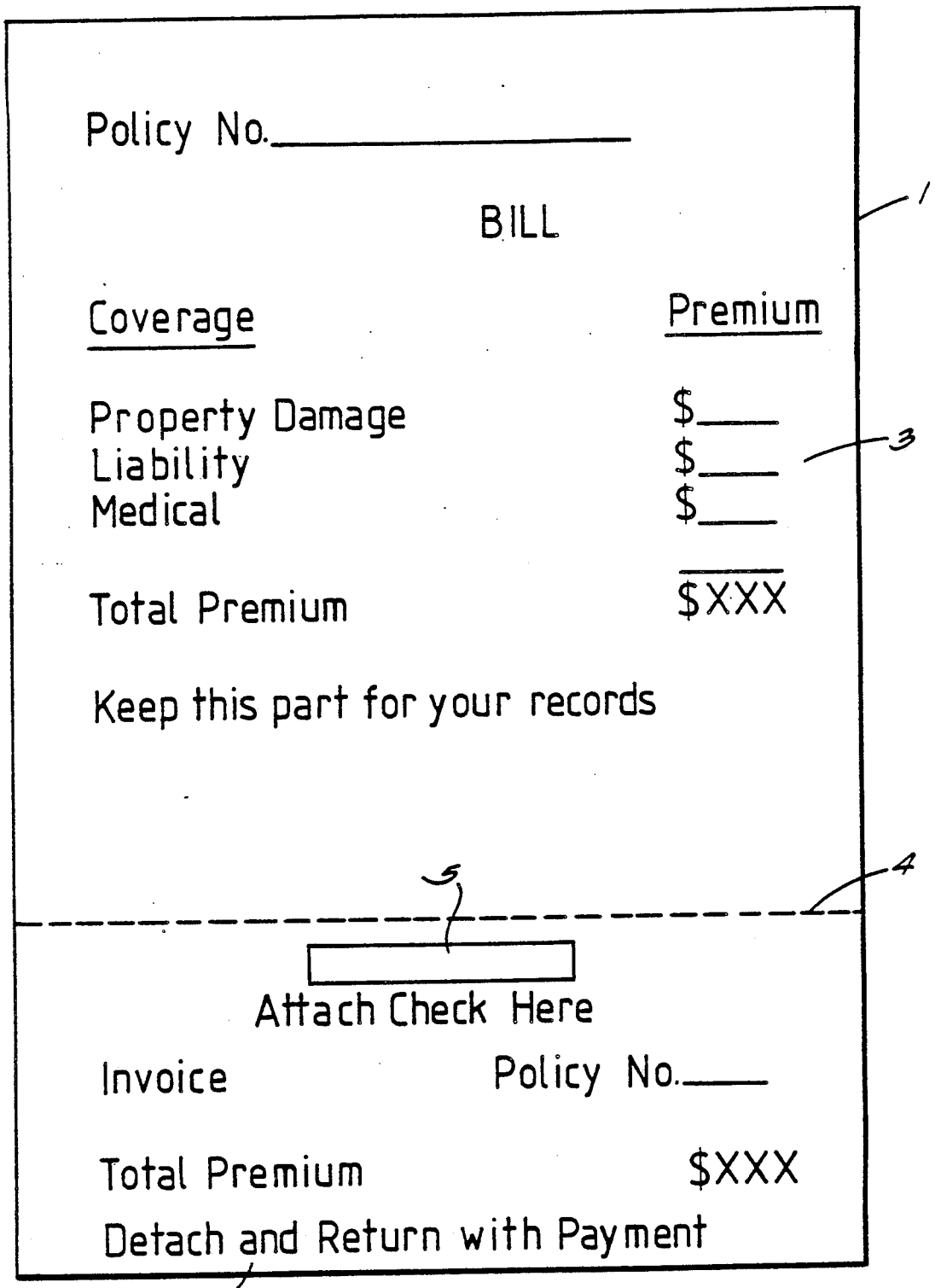
FIG. 1 Is a top perspective view of a document in accordance with the present invention.

FIG. 1 Illustrates a document in accordance with the present invention. This document would eventually have preprinted text or nontext indicia on at least one side of the document. The text and/or nontext on the bottom portion 2 is termed operative text or nontext in that it requires action by the holder of the document. The upper portion of the document 1 will generally contain informative text or nontext, which would conventionally be kept by the holder for his or her filing purposes. The operative portion 2 is commonly separated from the non-operative or informational portion 3 by a line of weakness 4. The line of weakness would allow removal or detachment of the operative from the non-operative portion of the document. Conventionally, the line of weakness 4 would comprise a serrated edge or the like.

A critical feature of the present invention lies in the use of the non-drying, lightly tacky pressure-sensitive adhesive strip 5. This adhesive strip can be applied at any convenient location on the operative portion of the document. As shown in FIG. 1 the adhesive strip 5 is adjacent and parallel to the line of weakness 4. However, any other convenient location on the operative text portion would be acceptable. The adhesive strip can be applied on the same side as the operative text or nontext or on a side opposite thereof.

The pressure sensitive adhesive employed would be of the type generally described in U.S. Pat. No. 4,714,276 and Swiss Patent No. 452,479, issued May 31, 1986, the substance of which are incorporated herein by reference. These patent documents demonstrate the use of bands of lightly tacky adhesive to create note pads and pads of preprinted forms respectively. These adhesive lines are applied at an upper margin of the sheets, which are stacked to form pads.

Figure 2:
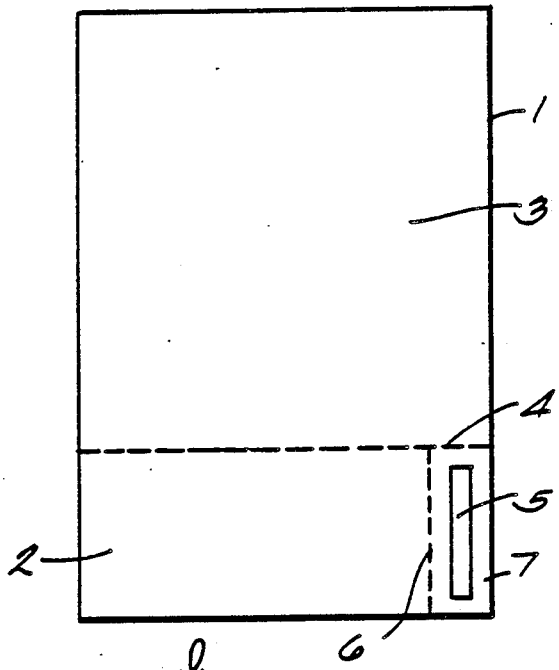
FIG. 2 Is a top perspective view of an alternative embodiment of the document depicted in FIG. 1.

As an alternative to the embodiment depicted in FIG. 1, FIG. 2 employs the same numerals to identify the same elements described in FIG. 1. In addition, the embodiment depicted in FIG. 2 shows a separate line 6. This line can be either a line of weakness or a fold line. When line 6 is a line of weakness adhesive strip 5 will be placed on the detachable section 7 of the operative text portion 2. Normally, section 7 would not contain operative text or nontext as it is removed and discarded following use. Such an embodiment is useful where the adhesive strip 5 would tend to complicate further handling of the operative text portion 2.

Alternatively, line 6 can be a fold line in which case adhesive strip 5 can be placed adjacent to and parallel with the line on either side thereof. The adhesive strip width would generally be less than the width of section 7. In this alternative section 7 would fold the adhesive strip into the operative text portion or cover the adhesive strip on the operative text portion 2. This embodiment again would cover the adhesive strip following use-to facilitate further handling of the operative portion 2. This alternative has the advantage in that the adhesive strip can be reused if such is required. Again generally text or nontext will normally not be present on section 7 or the area on portion 2 covered when section 7 is folded over.

Figure 3:
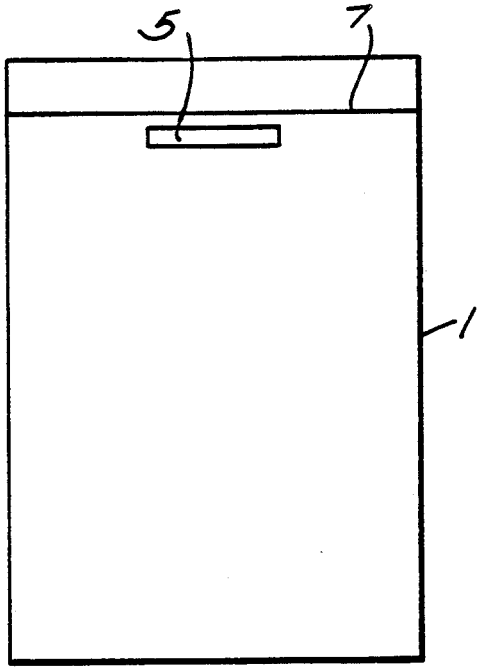
FIG. 3 Is a top view of an alternative embodiment of the present invention.

FIG. 3 Is an example of a document wherein the entire portion other than the adhesive area would be considered operative. Again, the same numerals are employed to designate elements corresponding to the FIG. 1 embodiment. In this case the adhesive strip can be placed at any portion of the document 1, which would be considered operative in its entirety. Should subsequent removal or covering of the adhesive strip be desired a fold line or line of weakness 7 can be used. As shown, the line 7 would be a fold line which folds over and covers the adhesive strip 5 when not in use.

The documents prepared in accordance with the teaching of the incident invention can be stacked or shipped in any conventional manner. The adhesive strip would temporarily bind adjacent documents, however, such is neither demanded nor required. If desired, the adhesive strip could be covered by removable paper strips. The adhesive being both releasable and reusable would not be adversely affected by attachment and detachment to adjacent or related documents or covering paper strips.

The adhesive can be located in any suitable location in any of the embodiments. The strip would generally be inside the outer edges of the document. This permits more ready attachment of the addendum without undesirable overhang of the addendum beyond the operative portion edge. The greater the distance between the strip and the operative portion edge, the greater the tolerance for error in attaching the addendum without overhang. However, if it is undesirable to have the strip within the operative text or nontext, a compromise must be reached between strip and text (or nontext) placement.

The strip would generally not extend from edge to edge of the operative portion. The addendum will most likely be smaller than the operative portion. As such, if the addendum is to cover the entire strip when attached to the document, the strips dimensions must be smaller than that of the operative portion of the document. Spillover of adhesive strip beyond the addendum edges complicates handling of the document/addendum and should generally be avoided.

The phrase operative text or nontext indicia is used in its broadest possible scope. Included within the definition of operative text or nontext would be any indicia which would require action on the part of the holder, particularly, any indicia requiring temporary attachment of an addendum to the operative portion of the document. Included in this definition would be invoices, statements, manifests, bills of lading, bills of accounts, bills, tax statements, government forms, application forms, tax forms, loan coupons, etc. Similarly, suitable addendums would include checks, notes, stock certificates, coupons, securities, notices, warnings, invoices, manifests, etc.

The invention in its broadest application would find suitable use with a wide range of forms which when used in conventional circumstances would require sending or use with a related addendum or temporarily and simultaneously handled with a related addendum. When such documents require separate handling the addendum can be readily detached from the operative portion of the document, which can be later reattached with the same or other addendum if desired.

Other embodiments of the invention will be apparent to those skilled in the art from a consideration of the specification or practice of the invention disclosed therein. It is intended that the specification and examples be considered as exemplary only with the true scope and spirit of the invention being indicated by the following claims.

I claim:

1. A printed document cmoprising at least one document sheet having preprinted thereon an invoice and a statement on one side of the sheet, the improvement wherein:

the invoice is on a first portion of the sheet, the statement is on a second portion of the sheet, and both the invoice and statement are on the same side of the sheet;

a line of weakness separates the first portion from the second portion, and the first portion is detachable from the document along the line of weakness; and a strip of non-drying, slightly tacky pressure-sensitive adhesive extends partially across the first portion of the sheet on the same side thereof as the invoice wherein the strip is of a size and location to permit attachment of a check to the strip without adhesive spillover.

2. The printed document of claim 1 wherein said strip of adhesive is on a detachable section of the first portion separated from the invoice by a line of weakness adapted for removal of the detachable section from the first portion of the sheet.

3. The printed document of claim 1 wherein said invoice containing said adhesive strip is removable from said sheet along said line of weakness.

* * * * *